US011512440B2

(12) United States Patent
Edl et al.

(10) Patent No.: US 11,512,440 B2
(45) Date of Patent: Nov. 29, 2022

(54) VERTICAL MEMBER FOR A VEHICLE RESTRAINT SYSTEM

(71) Applicant: DELTA BLOC INTERNATIONAL GMBH, Wöllersdorf-Steinabrückl (AT)

(72) Inventors: Thomas Edl, Müllendorf (AT); Steffen Lehmann, Leobersdorf (AT)

(73) Assignee: DELTA BLOC INIERNATIONAL GMBH, Wöllersdorf-Steinabrückl (AT)

( * ) Notice: Subject to any disclaimer, the term of this patent is extended or adjusted under 35 U.S.C. 154(b) by 0 days.

(21) Appl. No.: 17/261,773

(22) PCT Filed: Jul. 22, 2019

(86) PCT No.: PCT/EP2019/069695
§ 371 (c)(1),
(2) Date: Jan. 20, 2021

(87) PCT Pub. No.: WO2020/020833
PCT Pub. Date: Jan. 30, 2020

(65) Prior Publication Data

US 2021/0246619 A1 Aug. 12, 2021

(30) Foreign Application Priority Data

Jul. 24, 2018 (AT) ..... A 50645/2018

(51) Int. Cl.
*E01F 15/04* (2006.01)

(52) U.S. Cl.
CPC ..... *E01F 15/0469* (2013.01); *E01F 15/0423* (2013.01); *E01F 15/0476* (2013.01)

(58) Field of Classification Search
CPC ..... E01F 15/0461; E01F 15/0469; E01F 15/0476; E01F 15/0407; E01F 15/0423;
(Continued)

(56) References Cited

U.S. PATENT DOCUMENTS 4,126,403 A * 11/1978 Sweeney ..... E01F 9/635 403/11
4,330,106 A * 5/1982 Chisholm ..... E01F 15/0423 256/13.1
(Continued)

FOREIGN PATENT DOCUMENTS

AT 320711 B * 2/1975 ..... E01F 15/0438
CA 2806405 A1 * 8/2013 ..... E04H 17/168
(Continued)

OTHER PUBLICATIONS

Japanese Office Action received in Japanese Application No. 2021-504148 dated Aug. 26, 2021, 5 pages.
(Continued)

*Primary Examiner* — Matthew R McMahon
(74) *Attorney, Agent, or Firm* — Brian E Hennessey; Liang & Hennessey LLP

(57) ABSTRACT

A vertical member for a vehicle restraint system is intended for attaching a guard rail of the vehicle restraint system. The vertical member includes a profiled support and a reinforcing support within the profiled support, and the longitudinal axis of the reinforcing support runs substantially parallel to the longitudinal axis of the profiled support.

20 Claims, 2 Drawing Sheets

(58) Field of Classification Search
CPC ..... E01F 15/0438; E04H 17/20; E04H 17/21; E04H 17/22
USPC ..... 256/13.1
See application file for complete search history.

(56) References Cited

U.S. PATENT DOCUMENTS

| | | | | | |
|---|---|---|---|---|---|
| 5,125,194 | A * | 6/1992 | Granger | E01F 9/685 | 403/2 |
| 5,794,910 | A * | 8/1998 | Granger | E01F 9/635 | 248/548 |
| 6,065,894 | A * | 5/2000 | Wasson | E01F 15/0461 | 403/2 |
| 6,516,573 | B1 * | 2/2003 | Farrell | E01F 9/635 | 116/63 R |
| 7,604,221 | B2 * | 10/2009 | Lass | E01F 15/0453 | 256/13.1 |
| 7,794,173 | B2 * | 9/2010 | Amengual Pericas | E01F 15/0438 | 404/6 |
| 7,997,824 | B2 * | 8/2011 | Amengual Pericas | E01F 15/0453 | 404/6 |
| 8,215,619 | B2 * | 7/2012 | Leonhardt | E01F 15/025 | 256/13.1 |
| 8,517,349 | B1 * | 8/2013 | Ross | E01F 15/143 | 256/13.1 |
| 2008/0067484 | A1 * | 3/2008 | Amengual Pericas | E01F 15/0476 | 256/13.1 |
| 2008/0230759 | A1 * | 9/2008 | Lass | E01F 15/0453 | 256/13.1 |
| 2010/0243978 | A1 * | 9/2010 | Leonhardt | E01F 15/0461 | 256/13.1 |
| 2014/0145132 | A1 * | 5/2014 | Leonhardt | E01F 15/0461 | 256/13.1 |

FOREIGN PATENT DOCUMENTS

| | | | | | |
|---|---|---|---|---|---|
| CN | 1248307 | A | | 3/2000 | |
| CN | 1960899 | A | | 5/2007 | |
| CN | 102985618 | A | | 3/2013 | |
| DE | 10326414 | B3 | * | 8/2004 | E01F 15/0438 |
| DE | 202006015149 | U1 | | 12/2006 | |
| EP | 1486614 | A1 | * | 12/2004 | E01F 15/043 |
| FR | 2555622 | A1 | * | 5/1985 | E01F 15/0461 |
| FR | 2555622 | A1 | | 5/1985 | |
| FR | 2704012 | A1 | * | 10/1994 | E01F 15/0438 |
| FR | 2793501 | A1 | * | 11/2000 | E01F 15/043 |
| FR | 2793822 | A1 | * | 11/2000 | E01F 15/0438 |
| FR | 2874955 | A1 | * | 3/2006 | E04H 17/20 |
| JP | 2000345523 | A | | 12/2000 | |
| JP | 2010065496 | A | | 3/2010 | |
| JP | 2016006274 | A | | 1/2016 | |
| KR | 20050111539 | A | | 11/2005 | |
| KR | 20080031063 | A | * | 4/2008 | E01F 15/0438 |
| KR | 101007728 | B1 | * | 1/2011 | E01F 15/0461 |
| KR | 20120001028 | U | | 2/2012 | |
| KR | 101134563 | B1 | * | 4/2012 | E01F 15/0438 |
| WO | 9936631 | A1 | | 7/1999 | |
| WO | WO-9936631 | A1 | * | 7/1999 | E01F 15/043 |

OTHER PUBLICATIONS

Austria Application No. A 50645/2018, Office Action dated Dec. 28, 2018, 3 pages.
International Application No. PCT/EP2019/069695, International Search Report and Written Opinion dated Oct. 16, 2019, 13 pages.
International Application No. PCT/EP2019/069695, International Preliminary Examination Report dated Oct. 22, 2019, 18 pages.
Korean Office Action for Korean Application No. 10-2021-7005035 (dated Jun. 18, 2021) with English language summary, 7 pages.
Chinese First Office Action received in Chinese Application No. 201980048353.X dated Feb. 22, 2022, 17 pages.

* cited by examiner

VERTICAL MEMBER FOR A VEHICLE RESTRAINT SYSTEM

CROSS-REFERENCE TO RELATED APPLICATIONS

The present application is a national phase application of PCT Application No. PCT/EP2019/069695, filed Jul. 22, 2019, entitled "VERTICAL MEMBER FOR A VEHICLE RESTRAINT SYSTEM", which claims the benefit of Austrian Patent Application No. A 50645/2018, filed Jul. 24, 2018, each of which is incorporated by reference in its entirety.

BACKGROUND OF THE INVENTION

1. Field of the Invention

The invention relates to a vertical member for a vehicle restraint system.

2. Description of the Related Art

Conventional vehicle restraint systems typically feature multiple vertical members driven into the ground at constant intervals adjacent to the roadway, to which guard rails, usually made of steel, are attached. In a crash event, particularly a vehicle impact, the guard rail deforms and supports itself against the vertical members to which it is connected, which in turn deforms the vertical members, beginning in the ground, along much of their length. In a severe impact event, the guard rail usually also detaches from the vertical member after the vertical member has deformed over a certain angle. The degree of resistance that a guard rail offers to the impact of a vehicle depends primarily on the distance between the barriers and on the bending and torsional stiffness of the respective barriers.

As a rule, in order to increase the resistance of the guard rail to an impact event, the distance between the individual vertical members is reduced and vertical members with solid profiles or with at least closed profiles of higher steel grade are used.

DE 20 2006 015 149 U1 discloses a guard rail arrangement comprising posts into which reinforcing profiles are inserted. Both the post and the reinforcing profile are designed as open profiles.

FR 2 555 622 A1 shows a vertical member for a guard rail arrangement, which has a reinforcing element for a C-shaped profiled support.

KR 20 2012 0001028 U shows a tubular vertical member for height-adjustable mounting of a guard rail, wherein the vertical member comprises a round main post and at least one reinforcing post.

US 2014/0145132 A1 shows a vehicle restraint system comprising vertical members, wherein no reinforcing profiles are inserted into the vertical members.

The disadvantages of this are the high material costs and the associated increased material costs as well as significant disadvantages in the fastening of the vertical members in the ground, since a high force must be applied in order to ram the vertical members into the ground to a certain depth. Solid profiles in particular also require complicated installation of the guard rail on the vertical members.

SUMMARY OF THE INVENTION

It is therefore the object of the invention to provide a vertical member of the type mentioned at the beginning, with which the disadvantages mentioned can be avoided, with which the resistance of a guard rail against impact events is increased at a low material cost, as well as to enable a simple fastening of the vertical members in the substrate (also referred to as the ground) and a simple mounting of the guard rail on one or more vertical members.

According to the invention, this is achieved by the features of a vehicle restraint system that includes at least one vertical member in which the vertical member includes a profiled support and a reinforcing support arranged in the profiled support. A longitudinal axis of the reinforcing support is arranged substantially parallel to a longitudinal axis of the profiled support. The profiled support has two narrow sides and two broad sides, and the profiled support and the reinforcing support are detachably fastened to one another by means of a connecting device. At least one fastening device is arranged on at least one of the narrow sides of the profiled support, and at least one guard rail is fastened to the at least one vertical member by means of the at least one fastening device.

This has the advantage that material costs can be saved because, on the one hand, no solid profiled supports are required to increase the resistance of the vertical member to impact events and, on the other hand, the distance between the vertical members does not have to be reduced to increase the resistance of the guard rail to impact events. The reinforcing support can then be driven in separately. It is also advantageous that the composite cross-section of the vertical member offers significant advantages over a vertical member with a solid profile in the complex dynamic multi-axial loading process that changes direction over the time axis.

The subclaims relate to further advantageous embodiments of the invention.

Express reference is hereby made to the wording of the claims, whereby the claims are incorporated by reference into the description at this point and are deemed to be reproduced verbatim.

BRIEF DESCRIPTION OF THE DRAWINGS

The invention is described in more detail with reference to the enclosed drawings, in which only preferred embodiments are shown by way of example, wherein.

DETAILED DESCRIPTION

Figure 1:
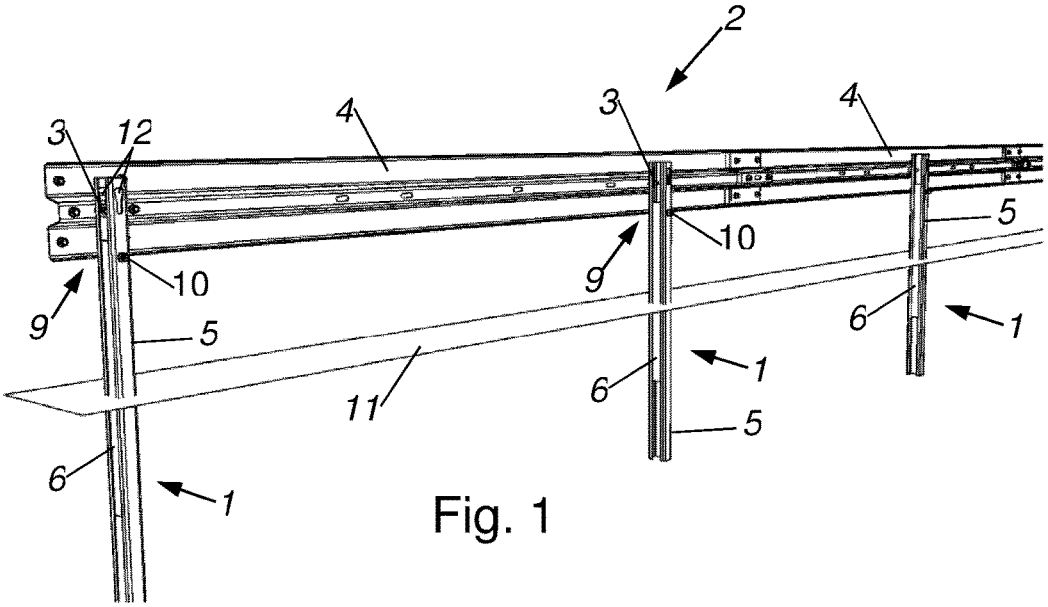
FIG. 1 shows a section of a preferred embodiment of the vehicle restraint system in perspective view.

FIGS. 1 to 10 show at least parts of preferred embodiments of a vertical member 1 for a vehicle restraint system 2, wherein the vertical member 1 has at least one fastening device 3 for fastening a guard rail 4 of the vehicle restraint system 2.

The vertical member 1 is provided to be fixed in a substrate 11 (or alternatively, ground 11), in particular to be rammed or driven into a floor, and serves to hold or support a guard rail 4. A vehicle restraint system 2 generally has a number of spaced-apart vertical members 1 and one or more guard rails 4 and spatially delimits roadways in order to reduce or prevent serious accidents. In order to fasten at least one guard rail 4 to a vertical member 1, the vertical member 1 has at least one fastening device 3, in particular a fastening opening 12, for accommodating at least one screw or threaded bolt. The screw or the threaded bolt is guided and screwed through the guard rail 4 and through the at least one fastening opening 12 of the vertical member 1 in order to fasten the guard rail 4 to the vertical member 1. It may also be provided that the guard rail 4 is fastened to the vertical member 1 by means of a hook or a clamp.

It is provided that the vertical member 1 comprises a profiled support 5 and a reinforcing support 6 arranged in the profiled support 5, and that the longitudinal axis of the reinforcing support 6 is arranged substantially parallel to the longitudinal axis of the profiled support 5.

The reinforcing support 6 acts as a reinforcing element for the profiled support 5. In other words, the reinforcing support 6 arranged in the profiled support 5 increases the moment of resistance or the bending and torsional stiffness of the vertical member 1. It is preferably provided that the reinforcing support 6 has a width that is only insignificantly smaller than a width of the profiled support 5. It is further preferably provided that the profile of the profiled support 5 remains the same along its length. It may also preferably be provided that the profile of the reinforcing support 6 remains the same over its length.

This leads to the advantage that material costs can be saved because, on the one hand, no profiled supports with solid profile are required to increase the resistance of the vertical member to impact events and, on the other hand, the distance between the vertical members does not have to be reduced to increase the resistance of the guard rail to impact events. The reinforcing support can then be driven in separately. It is also advantageous that the composite cross-section of the vertical member offers significant advantages over a vertical member with a solid profile in the complex dynamic multi-axial loading process that changes direction over the time axis.

Furthermore, a vehicle restraint system 2 comprising the at least one vertical member 1 is provided, wherein at least one guard rail 4 is attached to the at least one vertical member 1 by means of the fastening device 3.

FIG. 1 shows a section of a preferred embodiment of the vehicle restraint system 2 in perspective view, comprising a plurality of vertical members 1, each consisting of a profiled support 5 and a reinforcing support 6 arranged in the profiled support 5, the vertical members 1 being fastened in a substrate 11, and guard rails 4, which are fastened by means of bolts and corresponding nuts to fastening devices 3 on the respective end region 9 of the profiled supports 5 of the respective vertical members 1. The screws project through the respective guard rails 4 and through the respective aligned fastening devices 3, in particular fastening openings 12, of the vertical members 1.

Preferably, it can be provided that more than half of the length of the vertical member 1 is located in the substrate 11 in an assembly state. Substrate 11 means a floor in this case, in particular a floor at the edge of a roadway, or for example a median strip separating two lanes, in particular on a multi-lane highway with two-way traffic.

It may be provided that guard rails 4 are fastened to the vertical members 1 with, for example, an A profile or with a B profile. It may also be provided that the vertical members 1, in particular the profiled supports 5 of the vertical members 1, have further fastening openings 12 to which an underride guard can be fastened. An underride guard is intended to prevent serious injuries to motorcyclists who may slide under the crash barriers 4 in the event of an accident.

It may also be provided that the profiled support 5 and/or the reinforcing support 6 has more than one fastening device 3 for fastening a guard rail 4.

The twisting of the vertical member 1 during an impact event can cause the fastening device 3 to tilt and hook into the fastening opening 12, as a result of which the guard rail 4 does not detach from the vertical member 1. In order to prevent twisting of the vertical member 1 during a bending stress, it can preferably be provided that the profiled support 5 has two narrow sides 7 and two broad sides 8, wherein at least one fastening device 3 is arranged on at least one of the narrow sides 7 of the profiled support 5.

In order to further minimize the probability of twisting of the vertical member 1 in the event of an impact, it can be provided in a particularly preferred manner that the profiled support 5 and the reinforcing support 6 are detachably fastened to one another by means of a connecting device 10. Thus, it is possible to easily detach both supports 5, 6 from each other and to connect them with a defined pretension, in particular with a defined tightening torque. The fastening device 3 and the connecting device 10 are thus different. The detachable fastening of the profiled support 5 to the reinforcing support 6 further offers the advantage that in the case of a deformed profiled support 5 and an intact reinforcing support 6, the reinforcing support 6 can be fastened in a new profiled support 5. A further advantage is that the profiled support 5 and the reinforcing support 6 can be driven or hammered into the ground separately from each other, which means that less force is required than if both supports 5, 6 are driven or hammered into the ground together.

The respective profiled supports 5 and reinforcing supports 6 of the respective vertical members of the vehicle restraint system 2 are each connected to one another or fastened to one another by means of at least one connecting device 10.

It can preferably be provided that there is a clearance between the profiled support 5 and the reinforcing support 6, wherein the reinforcing support 6 is fastened in the profiled support 5 by means of the connecting device 10. For this purpose, it can be provided that the reinforcing support 6 can be arranged in the profiled support 5 without great force.

Particularly preferably, it can be provided that the at least one connecting device 10 connects the reinforcing support 6 and the profiled support 5 to one another in a form-fitting manner. For this purpose, it can be provided that the profiled support 5 has an opening and the reinforcing support 6 has a spring pin, wherein the spring pin engages in the opening.

The detachable fastening of the supports 5, 6 to one another by means of the connecting device 10 significantly increases the resistance of the supports 5, 6 and correspondingly the resistance of the vertical member 1 to bending and twisting, in particular the bending stiffness of the vertical member 1, since a shear-resistant connection is produced between the supports 5, 6, as a result of which the vertical member 1 is significantly more stable in the event of an impact than without the connecting device 10.

Figure 8:
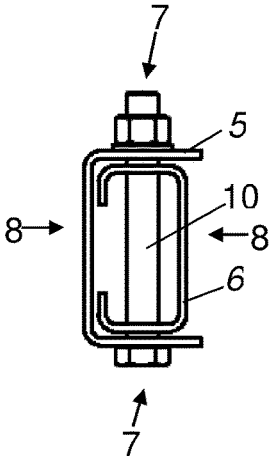
FIG. 8 shows a seventh preferred embodiment of the vertical member in plan view.
Figure 9:
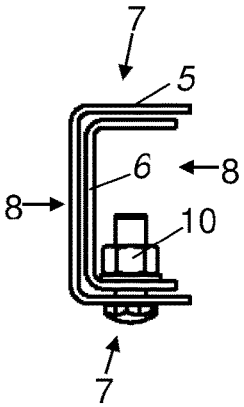
FIG. 9 shows an eighth preferred embodiment of the vertical member in plan view.
Figure 10:
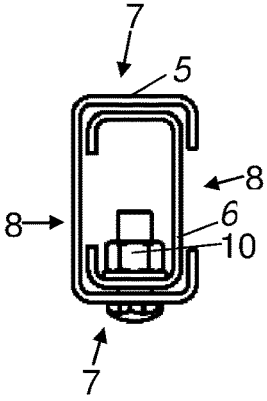
FIG. 10 shows a ninth preferred embodiment of the vertical member in plan view.

It may be further preferably provided that the reinforcing support 6 and the profiled support 5 have connecting openings arranged in an aligned manner and that the connecting device 10 reaches through both connecting openings, as shown by way of example in FIGS. 9 and 10. However, it may also preferably be provided that the profiled support 5 and the reinforcing support 6 have connecting openings arranged in alignment on both narrow sides 7 and that the connecting device 10 reaches through all four connecting openings, as shown by way of example in FIGS. 6 and 8. It may further be provided that the reinforcing support 6 can be movably arranged in the profiled support 5 in order to arrange the at least one connecting opening of the reinforcing support 6 in alignment with the connecting opening of the profiled support 5, in order to be able to pass the connecting device 10 through both connecting openings. By means of the connecting device 10, in particular when the connecting device 10 is screwed together, the narrow sides 7, in particular the profile legs of the narrow sides 7, of the profiled support 5 are pressed against the reinforcing support 6 when the supports 5, 6 are fastened to one another, as a result of which a composite beam, a so-called composite girder, is created by positive locking.

It may also be provided that the reinforcing support 6 and the profiled support 5 each have a plurality of connecting openings which can be arranged in alignment and through which a plurality of connecting devices 10 can be passed in order to fasten the supports 5, 6 releasably to one another. Accordingly, the supports 5, 6 can be fastened to one another by means of two, three or more than three connecting devices 10.

In particular, it may be provided that the reinforcing support 6 and the profiled support 5 are non-positively or frictionally connected to each other. In this case, the narrow sides 7 and at least parts of the broad sides 8 of the profiled support 5 and the reinforcing support 6 lie flat against each other, as illustrated by way of example in FIGS. 5 to 10. The flat abutment of at least parts of the narrow side 7 and/or the broad side 8 of the respective supports 5, 6 increases the friction between the supports 5, 6 and correspondingly the stability of the vertical member 1.

It may further be preferably provided that the reinforcing support 6 is clamped in a predeterminable manner in the profiled support 5 by means of the connecting device 10. By clamping the reinforcing support 6 in the profiled support 5, the friction between the reinforcing support 6 and the profiled support 5 is increased. By means of the connecting device 10, force is exerted on the profiled support 5, in particular on at least one profile leg of the profiled support 5 on at least one narrow side 7 of the profiled support 5. For this purpose, in particular a screw which extends through the corresponding connecting openings of the narrow sides of the supports 5,6 is screwed to a corresponding nut which is located on the outside of a narrow side of the profiled support 5. It may also be provided that by means of a screw clamp the reinforcing support 6 is clamped in the profiled support 5. Pressure is ultimately exerted on the reinforcing support 6 located in the profile of the profiled support 5 from one or both profile legs of the profiled support 5 and the reinforcing support 6 is thus clamped in the profiled support 5.

By means of the connecting device 10, the pressure of the profiled support 5 on the reinforcing support 6 can thus be adjusted, for example by tightening a screw and the corresponding nut or, for example, a screw clamp.

Figures 2, 3, 4:
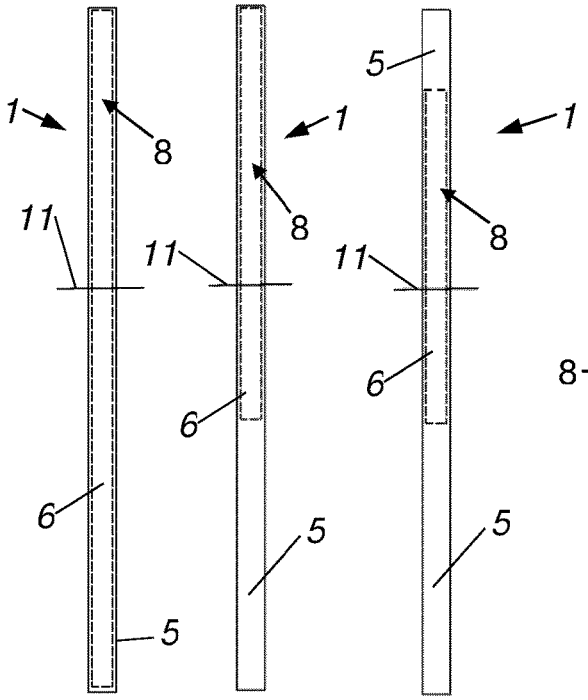
FIG. 2 shows a first preferred embodiment of the vertical member in rear view.
FIG. 3 shows a second preferred embodiment of the vertical member in rear view.
FIG. 4 shows a third preferred embodiment of the vertical member in rear view.

It can preferably be provided that the length of the reinforcing support 6 can be shorter than the length of the profiled support 5, thus saving material costs on the one hand and allowing the bending and torsional stiffness of the vertical member 1 to be selectively adjusted on the basis of the length of the reinforcing support 6 on the other. FIG. 2 shows an example of a reinforcing support 6 that has the same length as the profiled support 5, wherein more than half of the length of the vertical member is fixed in the substrate 11.

It may further be provided that the profiled support 5 and/or the reinforcing support 6 have a continuous constant profile.

In order to increase the bending stiffness of the vertical member 1 in the substrate 11 or in the vicinity of the substrate, it can preferably be provided that both the profiled support 5 and the reinforcing support 6 are fastened in the substrate 11, which is shown by way of example in FIG. 1. In this respect, it may be provided that more than half of the length of the profiled support 5 and at least one third, preferably at least half of the length of the reinforcing support 6 are fixed in the substrate 11. However, it can also be provided that a maximum of 50%, in particular a maximum of 30% and preferably a maximum of 20% of the reinforcing support 6 is fastened in the substrate 11.

Surprisingly, it has been recognized that it is not necessary to reinforce the entire length of the profiled support 5 by means of the reinforcing support 6 in order to achieve a significant increase in the torsional and bending stiffness of the vertical member 1. Preferably, the profiled support 5 is reinforced with the reinforcing support 6 mainly in the upper region, i.e. in the region above the substrate 11, wherein only a part of the reinforcing support 6 has to project into the substrate 11. In order to further increase the resistance of the vertical member 1 to impact events, the profiled support 5 projects in particular over a minimum of 30%, preferably over a minimum of 50%, particularly preferably over a minimum of 70%, of its length in the assembled state into the substrate 11. FIG. 3 shows an example of a reinforcing support 6 arranged in a profiled support 5, wherein the reinforcing support 6 is somewhat longer than half the length of the profiled support 5, wherein approximately less than one-third of the length of the reinforcing support 6 extend into the substrate 11.

It may preferably be provided that the reinforcing support 6 extends over a maximum of 50%, preferably over a maximum of 70%, particularly preferably over a maximum of 90%, of the length of the profiled support 5. It may also be provided that the reinforcing support 6 extends over a minimum of 40%, preferably over a minimum of 60%, particularly preferably over a minimum of 80%, of the length of the profiled support 5.

It can also preferably be provided that an area of the profiled support 5 in which the fastening device 3 is arranged is free of the reinforcing support 6. In this context, free means that the reinforcing support 6 does not extend into the area of the profiled support 5 in which the fastening device 3 is arranged. FIG. 4 shows an example of a vertical member 1 in rear view, respectively a broad side 8 of the profiled support 5 and a reinforcing support 6 arranged in the profiled support 5, wherein the vertical member 1 is rammed into the substrate 11, wherein an area of the profiled support 5 in which the fastening device 3 is arranged is free of the reinforcing support 6. The fastening device 3 is not shown in FIG. 4 in that it is arranged on one or both narrow sides 7 of the profiled support 5. The screw or the threaded bolt can be guided through the fastening device 3, in particular fastening opening 12, of the profiled support 5 and the nut can be screwed inside the section of the profiled support 5.

It is advantageous here that the guard rail 4 can be easily mounted on the profiled support 5. In this case, the fastening opening 12 preferably has an expansion area in which the screw can be loosened in a predeterminable manner. Preferably, the area of the profiled support 5 that is free of the reinforcing support 6 is located in, or at least in the vicinity of, the end area 9 of the profiled support 5.

Particularly preferably, it can be provided that the profiled support 5 has an open profile, in particular a C-profile or a U-profile. Furthermore, it may preferably be provided that the reinforcing support 6 has an open profile, in particular a C-profile or a U-profile. An open profile means here that the profile has at least one opening extending over the length of the profile. Preferably, it can be provided for this purpose that the open profile of the profiled support 5 forms, at least in sections, a receptacle for the reinforcing support 6. The C-profile or the U-profile of the profiled support 5 and/or of the reinforcing support 6 results in a wide range of possible arrangements of the reinforcing support 6 in the profiled support 5, as shown by way of example in FIGS. 5 to 10. It may also be provided that the profiled support 5 and/or the reinforcing support 6 have a G-profile. If the profiled support 5 has a U-profile, then the reinforcing support 6 can be inserted laterally into the profiled support 5 when the U-profile is opened. If the profiled support 5 has a C-profile, then the reinforcing support 6 can be inserted into the end face of the profiled support 5. Due to the geometry of the C-profile of the profiled support 5, the reinforcing support 6 is held in the profiled support 5, which results in good resistance or good rigidity of the vertical member 1 against twisting.

Due to the open profile of the profiled support 5, the profiled support 5 can be easily rammed into the ground, since, in contrast to a solid profile or a closed profile, less surface area of the profiled support 5 offers resistance to being rammed into the ground. Furthermore, due to the open profile of the profiled support 5, in particular of the vertical member 1, a guard rail 4 can be easily and effortlessly mounted to the same.

Preferably, the opening of the profile of the profiled support 5 is located on one of the broad sides 8 of the profiled support 5. In this way, in the event of an impact event, a straight and largely low-torsion bending of the profiled support 5 is achieved, as a result of which the screw is released from the fastening opening 12 in a controlled manner and thus also the guard rail 4 is released from the vertical member 1 in a controlled manner.

It can also preferably be provided that an area of the profiled support 5 in which the fastening device 3 is arranged is free of the reinforcing support 6. Free here means that the reinforcing support 6 does not extend into the area of the profiled support 5 in which the fastening device 3 is arranged. The screw or the threaded bolt can be guided through the fastening device 3, in particular fastening opening 12, of the profiled support 5 and the nut can be screwed inside the profile of the profiled support 5. It is advantageous here that the guard rail 4 can simply be mounted on the profiled support 5. The fastening opening 12 preferably has an expansion area in which the screw can be loosened in a predeterminable manner. Preferably, the area of the profiled support 5 that is free of the reinforcing support 6 is located in, or at least in the vicinity of, the end area 9 of the profiled support 5. The open profile of the profiled support 5 and the area of the fastening opening 12 that is free of the reinforcing support 6 result in a synergy effect, namely that the guard rail 4 can be mounted particularly easily on the profiled support 5.

Figure 5:
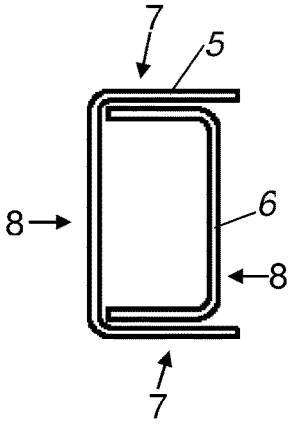
FIG. 5 shows a fourth preferred embodiment of the vertical member in plan view.

It can preferably be provided that at least one wall surface of the reinforcing support 6 covers an opening in the profiled support 5 caused by the open profile. This has the advantage that dirt and other environmental influences can only reach the inner walls of the profiled support 5 and the reinforcing support 6 at the covered points with difficulty and not directly, which has a positive effect on the durability, in particular through reduced corrosion, of the vertical member 1. FIG. 5 shows an example of a profiled support 5 and a reinforcing support 6, each with a U-profile. The reinforcing support 6 is arranged rotated by 180° in relation to the profiled support 5 in the profile of the profiled support 5, with the reinforcing support 6 covering the opening of the profiled support 5 by a wall surface.

Figure 6:
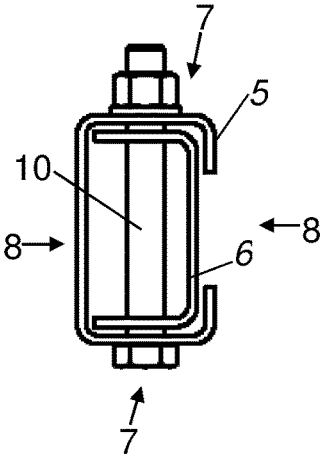
FIG. 6 shows a fifth preferred embodiment of the vertical member in plan view.

FIG. 6 shows an example of a reinforcing support 6 with a U-profile arranged in the C-profile of a profiled support 5. The profiled support 5 and the reinforcing support 6 each have connecting openings arranged in alignment on both narrow sides 7 and the connecting device 10, in particular consisting of a screw and a nut, engages through all four connecting openings. The connecting openings arranged in an aligned manner are not illustrated in FIGS. 1 to 10. The reinforcing support 6 is arranged in the profiled support 5 rotated by 180° with respect to the orientation of the profiled support 5, wherein the reinforcing support 6 covers the opening of the profile of the profiled support 5 by at least one wall surface.

Figure 7:
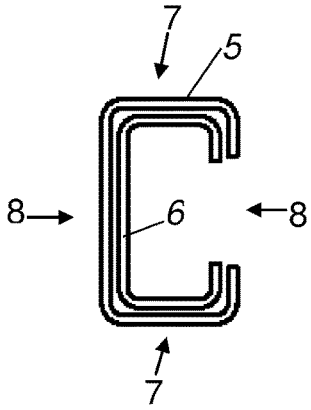
FIG. 7 shows a sixth preferred embodiment of the vertical member in plan view.

FIG. 7 shows an example of a profiled support 5 and a reinforcing support 6, each with a C-profile, wherein the section of the reinforcing support 6 is arranged positively and parallel to the alignment of the profiled support 5 in the latter. The opening of the C-profile of the reinforcing support 6 is thus parallel to the opening of the C-profile of the profiled support 5.

FIG. 8 shows an example of a reinforcing support 6 with a C-profile, which is arranged in the U-profile of a profiled support 5. The profiled support 5 and the reinforcing support 6 each have connecting openings arranged in alignment on both narrow sides 7 and the connecting device 10, in particular consisting of a screw and a nut, engages through all four connecting openings. The reinforcing support 6 is arranged rotated by 180° in relation to the profiled support 5 in the profile of the profiled support 5, wherein the reinforcing support 6 covers the opening of the profiled support 5 by a wall surface.

FIG. 9 shows an example of a profiled support 5 and a reinforcing support 6, each with a U-profile, wherein the profile of the reinforcing support 6 is arranged positively and parallel to the alignment of the profiled support 5 in the latter. The opening of the U-profile of the reinforcing support 6 is thus parallel to the opening of the U-profile of the profiled support 5. The profiled support 5 and the reinforcing support 6 each have connecting openings arranged in alignment on one of their narrow sides 7, and the connecting device 10, consisting in particular of a screw and a nut, engages through the aligned connecting openings of the supports 5, 6. The nut is screwed inside the profiles of both supports 5, 6.

FIG. 10 shows an example of a reinforcing support 6 with a C-profile, which is arranged in the C-profile of a profiled support 5. The profiled support 5 and the reinforcing support 6 each have connecting openings arranged in alignment on both narrow sides 7. The reinforcing support 6 is arranged in the profile of the profiled support 5 rotated by 180° with respect to the profiled support 5, wherein the reinforcing support 6 covers the opening of the profile of the profiled support 5 by a wall surface. Due to the opposing arrangement of the open profiles of the supports 5, 6, a particularly straight and low-torsion bending of the supports 5, 6, in particular of the profiled support 5, can be achieved in the event of an impact. The profiled support 5 and the reinforcing support 6 each have connecting openings arranged in alignment on one of their narrow sides 7, and the connecting device 10, in particular consisting of a bolt and a nut, engages through the aligned connecting openings of the supports 5, 6.

It is provided in a particularly preferred manner that the reinforcing support 6 has a lower steel grade than the profiled support 5, thus saving costs. For example, the material of the reinforcing support 6 may have a lower yield strength and/or tensile strength than the material of the profiled support 5.

The invention claimed is:

1. A vehicle restraint system, comprising:

at least one vertical member, wherein the vertical member comprises a profiled support and a reinforcing support arranged in the profiled support, both the profiled support and the reinforcing support being fastened in a substrate, the reinforcing support increasing a moment of resistance of the vertical member, a longitudinal axis of the reinforcing support being arranged substantially parallel to a longitudinal axis of the profiled support, the profiled support forming a substantially rectangular cross-section perpendicular to the longitudinal axis and having two narrow sides and at least one broad side of the substantially rectangular cross-section, the profiled support and the reinforcing support being detachably fastened to one another by a connecting device;

at least one fastening device arranged on at least one of the narrow sides of the profiled support in an area of the profiled support free of the reinforcing support; and at least one guard rail fastened to the at least one vertical member by the at least one fastening device;

wherein the reinforcing support and the profiled support have openings arranged in an aligned manner, and the connecting device passes through both openings;

wherein the cross-section of the profiled support is an open profile comprising one of a C-profile and a U-profile;

wherein there is a clearance between the profiled support and the reinforcing support; and wherein the reinforcing support is fixed in the profiled support by the connecting device.

2. The vehicle restraint system according to claim 1, wherein the at least one connecting device connects the reinforcing support and the profiled support to one another in a form-fitting manner.

3. The vehicle restraint system according to claim 1, wherein the reinforcing support is clamped in a predeterminable manner in the profiled support by the connecting device.

4. The vehicle restraint system according to claim 1, wherein a length of the reinforcing support is shorter than a length of the profiled support.

5. The vehicle restraint system according to claim 1, wherein the reinforcing support extends over a maximum of 50% of the length of the profiled support.

6. The vehicle restraint system according to claim 1, wherein the reinforcing support extends over a maximum of 70% of the length of the profiled support.

7. The vehicle restraint system according to claim 1, wherein the reinforcing support extends over a maximum of 90% of the length of the profiled support.

8. The vehicle restraint system according to claim 1, wherein at least one wall surface of the reinforcing support covers a sectional opening of the profiled support caused by the open profile.

9. The vehicle restraint system according to claim 8, wherein:

the cross-section of the profiled support is the C-profile; and another cross-section of the reinforcing support is a C-profile.

10. The vehicle restraint system according to claim 1, wherein another cross-section of the reinforcing support is another open profile.

11. The vehicle restraint system according to claim 10, wherein the other cross-section of the reinforcing support is one of another C-profile and another U-profile.

12. The vehicle restraint system according to claim 11, wherein:

a first gap in the C- or U-profile of the profiled support is on a first broad side of the cross-section of the profiled support;

a second gap in the C- or U-profile of the reinforcing support is on a second broad side of the other cross-section of the reinforcing support; and the first and second gaps are not aligned when the reinforcing support is arranged in the profiled support.

13. The vehicle restraint system according to claim 1, wherein the reinforcing support has a lower steel grade than the profiled support.

14. The vehicle restraint system according to claim 1, wherein the connecting device extends through at least one of the narrow sides of the profiled support.

15. The vehicle restraint system according to claim 14, wherein the connecting device extends through the two narrow sides of the profiled support.

16. The vehicle restraint system according to claim 1, wherein:

the cross-section of the profiled support is the C-profile;

another cross-section of the reinforcing support is a C-profile; and a sectional opening of the profiled support aligns with a further sectional opening of the reinforcing support.

17. The vehicle restraint system according to claim 1, wherein the reinforcing support extends over a minimum of 40% and over a maximum of 90% of a length of the profiled support.

18. The vehicle restraint system according to claim 1, wherein, in an assembled state, the profiled support projects over a minimum of 30% of a length of the profiled support into the substrate.

19. The vehicle restraint system according to claim 1, The vehicle restraint system according to claim 16, wherein the at least one vertical member of the vehicle restraint system consists of the profiled support and the reinforcing support.

20. The vehicle restraint system according to claim 1, wherein:

the reinforcing support increases a bending stiffness of the vertical member; and the reinforcing support increases a torsional stiffness of the vertical member.

* * * * *